US008295744B2

(12) United States Patent
Breitenbach

(10) Patent No.: US 8,295,744 B2
(45) Date of Patent: Oct. 23, 2012

(54) TONER ROLLER

(75) Inventor: Alexander Breitenbach, Graefelfing (DE)

(73) Assignee: Océ Printing Systems GmbH, Poing (DE)

( * ) Notice: Subject to any disclaimer, the term of this patent is extended or adjusted under 35 U.S.C. 154(b) by 262 days.

(21) Appl. No.: 12/712,250

(22) Filed: Feb. 25, 2010

(65) Prior Publication Data

US 2010/0215411 A1 Aug. 26, 2010

(30) Foreign Application Priority Data

Feb. 26, 2009 (DE) ..... 10 2009 010 624

(51) Int. Cl.
*G03G 15/08* (2006.01)

(52) U.S. Cl. ..... 399/279; 399/286

(58) Field of Classification Search ..... 399/49, 399/279, 286
See application file for complete search history.

(56) References Cited

U.S. PATENT DOCUMENTS

| | | | | |
|---|---|---|---|---|
| 4,990,963 | A * | 2/1991 | Yamamoto et al. | 399/286 |
| 5,697,027 | A * | 12/1997 | Takagi et al. | 399/279 |
| 5,869,808 | A * | 2/1999 | Hyllberg | 219/216 |
| 6,226,483 | B1 * | 5/2001 | Kazakos et al. | 399/266 |
| 6,327,452 | B1 * | 12/2001 | Jaskowiak et al. | 399/286 |
| 2007/0223973 | A1 * | 9/2007 | Froschl et al. | 399/273 |

* cited by examiner

*Primary Examiner* — Walter L Lindsay, Jr.
*Assistant Examiner* — Frederick Wenderoth
(74) *Attorney, Agent, or Firm* — Schiff Hardin LLP

(57) ABSTRACT

In a toner roller that is suitable to take up a layer with toner particles on its outer surface. The toner roller has a roller-shaped inner body, and wherein a dielectric layer is arranged at an outer surface of the inner body. A high-resistance cover layer is located on said dielectric layer.

13 Claims, 5 Drawing Sheets

TONER ROLLER

BACKGROUND

The preferred embodiment concerns a toner roller that is suitable to take up a layer of toner particles on its surface shell (generated surface) and that comprises a roller-shaped inner body. A dielectric layer is arranged on the surface shell of the inner body.

The toner roller according to the preferred embodiment is in particular used in developer stations of printers or copiers. The toner roller is, for example, used as a developer roller that is situated opposite an intermediate image carrier. The intermediate image carrier is, for example, a photoconductor belt and carries a latent charge image corresponding to an image to be printed. The latent charge image of the intermediate image carrier is inked with toner with the aid of the developer roller. For this the developer roller must carry a homogeneous layer of toner particles in operation. A voltage potential is applied to the developer roller, with the help of which the transfer of the electrically charged toner particles from an inking roller to the surface of the developer roller and the transfer from this developer roller to the intermediate image carrier is assisted. The toner roller according to the preferred embodiment can also be used as a cleaning roller, for example, with the help of which toner and carrier particles that are not transferred from the developer roller to the intermediate image carrier are cleaned from the developer roller.

Depending on the use, the toner roller must satisfy different requirements. Given a developer roller, the discharging and charging of the developer roller must occur in short time spans, for example. In contrast to this, given a cleaning roller the discharge should occur as slowly as possible so that as many toner particles as possible can be cleaned off the developer roller. The developer roller must also be provided such that the correct amount of toner is applied to it. If too few or too many toner particles are applied on the developer roller, a stable, homogeneous development of the latent charge image of the intermediate image carrier is not ensured. Furthermore, the developer roller must have a sufficiently high breakdown resistance.

In the document DE 10 2008 050 745.8 (not published before the filing of the instant corresponding German Priority Document), a toner roller is proposed that is suitable to take up a layer with toner particles on its surface shell. The toner roller has a base body made of a material whose specific resistance $>10^{-4}$ Ω/cm and a modulus of elasticity of which is greater than 50 kN/mm$^2$. An electrically conductive layer that is charged with an electrical potential is arranged on the surface of the base body.

A method for treating the surface of a toner-transporting roller is known from the document US 2007223973 A1. The surface of the roller is coated with a ceramic layer that is subsequently exposed with a grit (shot), in particular with glass spheres. Scaling, oxidation layers and soiling of the ceramic layer are removed via this method, and this ceramic layer is additionally re-pressed.

SUMMARY

It is an object to specify a toner roller that is simple to produce, has versatile uses and of electrical properties which can be adapted in a simple manner to the requirements posed for the toner roller depending on its use.

A toner roller suitable to take up a layer with toner particles comprises a roller-shaped inner body. A dielectric layer is arranged at an outer surface of the inner body. A cover layer to protect the dielectric layer is arranged on a surface of the dielectric layer. The cover layer has an electrical conductivity which is higher than an electrical conductivity of the dielectric layer.

DESCRIPTION OF THE PREFERRED EMBODIMENTS

Figure 1:
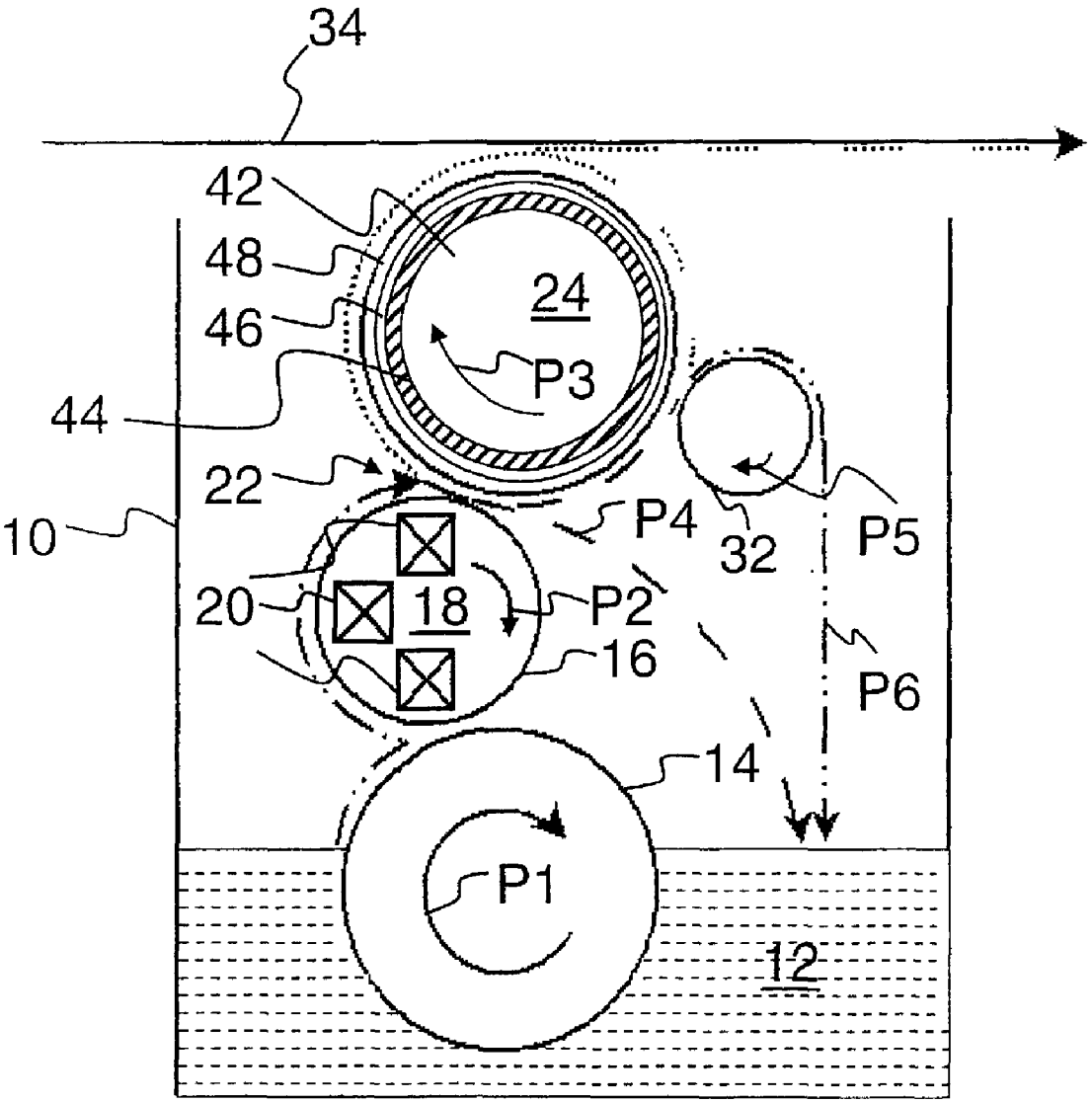
FIG. 1 is a schematic representation of a developer station.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

According to one preferred embodiment, the toner roller comprises a roller-shaped inner body on a generated surface of which is arranged a dielectric layer. A cover layer to protect the dielectric layer is arranged on the surface of the dielectric layer, wherein the cover layer has a higher electrical conductivity than the dielectric layer.

The dielectric layer advantageously is comprised of an enameling, an inorganic lacquer (coating, finish; varnish), anodized aluminum or a ceramic, in particular an oxide ceramic. Via the selection of the substances that are used, and thus of their electrical conductivities and their permittivities, and via the selection of the layer thickness of the dielectric layer, the capacitance of the toner roller, the breakdown resistance and/or the charge and discharge behavior can be adapted to the demands placed on the toner roller depending on its use. The thinner the dielectric layer that is used and the greater the permittivity of the material which the dielectric layer is comprised of the higher the capacitance of the toner roller. The higher the capacitance of the toner roller, the more electrically charged toner particles adhere to the toner roller given an electrical field of the same field strength. In particular the toner amount applied to a developer roller can be adjusted in this way. Via the capacitance and the resistance of the toner roller, its temporal charge and discharge behavior can be preset. The higher the capacitance and the higher the electrical resistance, the slower that the toner roller discharges. The temporal behavior of the charging and discharging is also designated in the following as a time response.

The cover layer protects the dielectric layer primarily from abrasion, in particular from abrasion due to the contact with other rollers or with the developer mixture in which the toner particles are located. On the other hand, the cover layer protects the dielectric layer from the introduction of moisture. In particular given the use of a material for the dielectric layer that has pores, the absorption of moisture is prevented by the cover layer.

It is also advantageous when the cover layer has an optimally high electrical resistance on the one hand but on the other hand has a higher conductivity than the dielectric layer. The electrical resistance of the cover layer is in particular at least 3 kD. It is hereby achieved that an electrostatic charging of the cover layer is minimized. Via the electrical conductivity of the cover layer it is achieved that the charging on the cover layer is uniformly distributed, such that no charge spikes occur. A homogeneous distribution of the toner on the surface of the cover layer with a defined thickness of the toner layer is hereby achieved in turn. It is also hereby ensured that the electrical properties of the dielectric layer are not or are only slightly affected by the cover layer.

Furthermore, it is advantageous when the cover layer is homogeneous and the surface shell of the dielectric layer is completely covered by the cover layer. A homogeneous distribution of the toner on the surface of the cover layer is hereby achieved again.

The cover layer of the toner roller advantageously is comprised of a coating, an enameling, a plastic or a ceramic. The selection of the material of the cover layer in particular occurs depending on the material used for the dielectric layer. The material of the dielectric layer and the material of the cover layer are in particular matched to one another, such that a sufficient adhesion of the cover layer to the dielectric layer is ensured.

In a preferred embodiment of the invention, the inner body comprises a tube-shaped base body or a roller-shaped base body comprised of a solid material. The base body is respectively borne at its two axial ends with the aid of at least one bearing element. The weight of the toner roller is reduced via a tube-shaped base body, and thus on the one hand the handling is facilitated and on the other hand the production costs are reduced. The toner roller must also exhibit a sufficient mechanical stability and may not bend during the operation in the printer or copier, since this can lead to errors in the print image. The bending of the toner roller is reduced or prevented via the use of a base body with a solid profile. The base body advantageously is comprised of steel, an aluminum-brass alloy or a composite material.

In a preferred embodiment Of the invention, the inner body comprises a roller-shaped base body and an adhesion layer applied to the surface shell of the base body. The dielectric layer is in turn applied on the surface of the adhesion layer. The adhesion layer in particular serves for the mechanical adhesion of the dielectric layer insofar as no sufficient mechanical adhesion of the dielectric on the base body exists due to the materials used for the base body.

If the base body is comprised of a material that has an electrical conductivity of less than $10^6$ S/m at room temperature; an adhesion layer that is comprised of a material that has an electrical conductivity of at least $10^6$ S/m at room temperature must be applied to the base body. All specifications made in the following regarding the electrical conductivity refer to the electrical conductivity at room temperature. If the base body is comprised of a material with a conductivity of less than $10^6$ S/m, an electrically conductive adhesion layer must then be applied even if the mechanical adhesion of the dielectric layer on to the base body would be sufficient even without an adhesion layer. In contrast to this, if the base body is produced from a material whose electrical conductivity is greater than $10^6$ S/m, the adhesion layer is only necessarily required if the mechanical adhesion of the dielectric layer on the base body is directly insufficient. In this case the adhesion layer can also be comprised of both a material with an electrical conductivity greater than $10^6$ S/m and a material with a conductivity of less than $10^6$ S/m. In particular aluminum, molybdenum, chromium nickel or electroless nickel are used as materials for the adhesion layer. Since at least the base body or the adhesion layer is electrically conductive, it is achieved that at least this electrically conductive part of the inner body can be charged with a potential.

The base body advantageously is comprised of glass, glass fibers, plastic, a composite material, a ceramic, steel or an aluminum-brass alloy. The selection of the materials of the base body, the adhesion layer, the dielectric layer and the cover layer in particular occurs such that the materials are matched to one another, in particular that a sufficient mechanical adhesion of the respective layers applied on one another is ensured.

In a preferred embodiment of the invention, the base body is comprised of glass, the adhesion layer applied on the surface shell of the base body is comprised of aluminum, the dielectric layer applied on the adhesion layer is comprised of aluminum titanate and the cover layer consists of chromium oxide. The dielectric layer and the cover layer respectively advantageously have a thickness in the range from 50 to 150 μm, in particular a thickness of 100 μm. The adhesion layer advantageously has a thickness between 20 and 100 μm, in particular a thickness of 50 μm.

In an alternative embodiment of the invention, the base body is comprised of steel, the dielectric layer applied on the surface shell of the base body is comprised of aluminum titanate, and the cover layer is comprised of chromium oxide. The base body made of steel is advantageously designed in the shape of a tube.

The transition between the base body and the adhesion layer, the transition between the adhesion layer and the dielectric layer and/or the transition between the dielectric layer and the cover layer are continuous. Alternatively, one of the transitions or more of the transitions can be graduated.

Additional features and advantages of the preferred embodiment result from the following description which is explained in detail using exemplary embodiments in connection with the drawing figures.

A schematic representation of a developer station 10 is shown in FIG. 1. Located in the developer station 10 is a developer mixture 12 that comprises toner particles and ferromagnetic carrier particles. The developer mixture 12 is stirred in the arrow direction P1 with the aid of a mixture dredger 14, whereby the toner particles charge triboelectrically. The mixture dredger 14 transports the developer mixture 12 on its surface to a hollow inking roller 16 that internally contains a stationary magnet arrangement 18 with three magnets 20. Upon rotating the sleeve [shell, casing) of the inking roller 16 in the direction of the arrow P2, the carrier particles with the toner particles adhering to them are transported further in the direction of a developer roller 24, wherein a magnetic brush develops along the field lines of the magnets 20. In a contact region 22 of the inking roller 16 and the developer roller 24, the toner particles are now transferred to the surface of the developer roller 24 under the influence of an electrical field that stems from different potentials of the developer roller 24 and the inking roller 16.

The inking roller 16 is advantageously charged with a direct voltage potential of a direct voltage source (not shown). The developer roller 24 or at least an electrically conductive part of the developer roller 24 is charged with a direct voltage over which an alternating voltage from a voltage source (likewise not shown) can be laid.

Due to the electrical field forces, the toner particles are transferred from the inking roller 16 to the surface of the developer roller 24 and held there. The toner particles held on the developer roller 24 are transported further in the rotation direction P3 upon rotation of the developer roller 24 while the ferromagnetic carrier particles are conveyed from the inking roller 16 back to the developer mixture 12 in the direction of the arrow P4. The toner particles adhering to the surface of the developer roller 24 are advanced to a photosensitive layer of an intermediate image carrier 34 and jump across to this photosensitive layer as a result of the field forces that are present due to a latent charge image between the photosensitive layer of the intermediate image carrier 34 and the developer roller 24. The latent charge image on the intermediate image carrier 34 is thus inked. The intermediate image carrier 34 is in particular a belt-shaped photoconductor. Due to the jumping of the toner particles from the developer roller 24 to the intermediate image carrier 34, the developer roller 24 is also designated as a jump roller. The air gap between the intermediate image carrier 34 and the surface of the developer roller 24 lies in the range between 40 and 500 μm, with an average of approximately 200 μm.

The toner particles that have not jumped from the developer roller 24 to the intermediate image carrier 34 are cleaned off the developer roller 24 with the aid of the cleaning roller 32. The cleaning roller 32 rotates in the direction of the arrow P5. The cleaned-off toner particles are resupplied to the developer mixture 12, as indicated by the arrow P6. The cleaning roller 32 is charged with a direct voltage potential that is opposite the potential of the inking roller 16. The potential applied to the cleaning roller 32 assists the cleaning of the toner particles from the surface of the developer roller 24.

The potentials of the inking roller 16, the developer roller 24 and the cleaning roller 32 are selected such that the toner particles are conveyed on the one hand from the developer mixture 22 to the intermediate image carrier 34 and on the other hand can detach from the surface of the developer roller 24 in order to jump across onto the photosensitive layer of the intermediate image carrier 34 that is charged with charges.

It is here important that a homogeneous layer of toner particles with a preset layer thickness is applied on the developer roller 24 in order to thus ensure a stable, homogeneous development of the latent charge image on the intermediate image carrier 34. A high print quality is thus ensured in turn.

Figure 2:
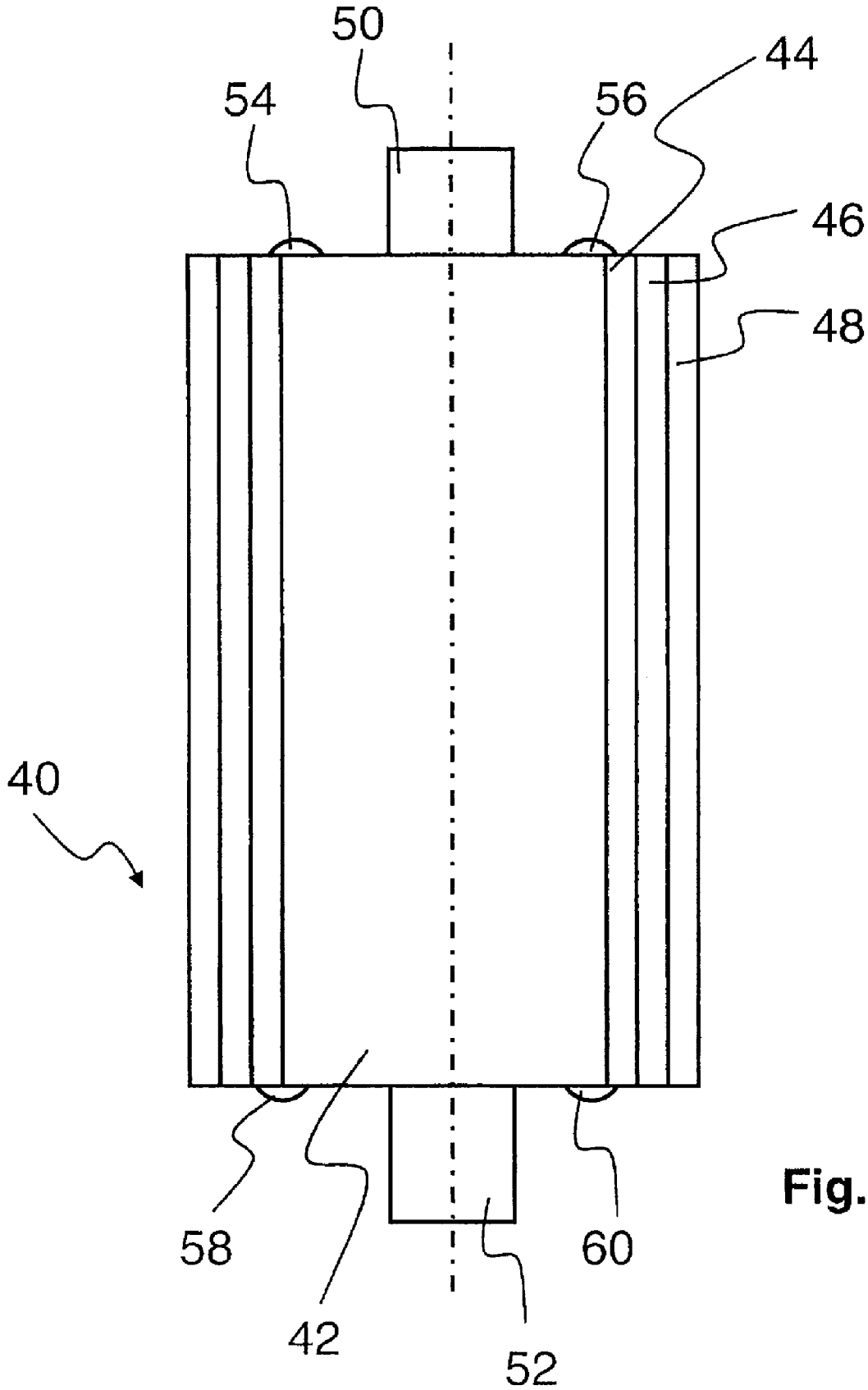
FIG. 2 is a longitudinal section through a toner roller according to a first embodiment of the invention.

A longitudinal section through a toner roller 40 according to a first embodiment of the invention is shown in FIG. 2. Elements with identical design or identical function have the same reference characters. The toner roller 40 is in particular used as a developer roller 24 in a developer station 10. The toner roller 40 can also be used in other developer stations than the developer station 10 according to FIG. 1, in particular in developer stations in which liquid toner is used. The toner roller 40 can also be used as a cleaning roller 32 in the developer station 10. Moreover, the toner roller 40 according to the preferred embodiment can also be used in additional components of a printer or copier. Depending on the usage purpose of the toner roller 40, the electrical properties of the toner roller 40 (in particular the capacitance and the electrical resistance) must be adapted to the respective requirements. This occurs in a simple manner via a corresponding adaptation of the design of the toner roller 40 (which design is explained in detail in the following), in particular via the selection of the materials used and the dimensions of individual layers of the toner roller 40.

The toner roller 40 comprises a base body 42, an adhesion layer 44, a dielectric layer 46 and a cover layer 48. The base body 42 is essentially designed as a cylinder. The base body 42 can be designed both to be internally hollow (and thus as a hollow cylinder) and to have a solid profile. The selection of the profile of the base body 42 in particular occurs depending on the modulus of elasticity of the material from which the base body 42 is formed. The elasticity of the toner roller 40 depends essentially on the elasticity of the base body 42. If this base body 42 (and thus the toner roller 40) is too elastic, it can bend in the production and/or given later use in a printer or copier, whereby a homogeneous structure of the toner roller 40 and/or a homogeneous development of the latent charge image on the intermediate image carrier 34 can be impaired. The flexural strength (deflection resistance) of the toner roller 40 is increased by the use of a solid profile for the base body 42. Conversely, the weight of the toner roller 40 is reduced by the use of a hollow profile, and thus the handling on the one hand and the manufacturing costs on the other hand are reduced.

The base body 42 can be comprised both of an electrically conductive material and of an electrically non-conductive or only slightly electrically conductive material. In the following materials an electrical conductivity of which at room temperature is less than $10^6$ S/m are designated as electrically non-conductive or only slightly electrically conductive. In particular glass, fiberglass, plastics, ceramics and composite material (in particular chlorofluorocarbon materials or fiberglass-reinforced plastics) are used as electrically non-conductive or only slightly electrically conductive materials. In particular aluminum-brass alloys, composite materials or steel (in particular structural steel or chromium nickel steel) are used as electrically conductive materials.

The adhesion layer 44 is arranged on the surface shell of the base body 42. An adhesion of the dielectric layer 46 is achieved by the adhesion layer 44, in particular when a mechanical adhesion of the dielectric layer 46 directly to the surface shell of the base body 42 is not possible or if the adhesion is too low. If the base body 42 is comprised of an electrically non-conductive material or an only slightly electrically conductive material, the adhesion layer must be comprised of a material that is electrically conductive, i.e. has an electrical conductivity of at least $10^6$ S/m. Contrary to this, if the base body is comprised of an exposure material the adhesion layer does not necessarily have to likewise be comprised of an electrically conductive material. If the base body 42 is comprised of an exposure material, an adhesion layer 44 can be omitted (as is explained in further detail in connection with FIGS. 4 and 5) insofar as the mechanical adhesion of the dielectric layer 46 to the base body 42 is also sufficient without an adhesion layer 44 arranged between them.

The adhesion layer 44 is comprised of, for example, aluminum, molybdenum, chromium nickel or electroless nickel. The selection of the material depends, for example, on the coating method that is used and/or the materials of the base body 42 and the dielectric layer 46. The base body 42 and the adhesion layer 44 are also designated together as an inner body of the toner roller 40. The base body 42 is respectively solidly connected at its axial ends with a bearing element 50, 52, in particular respectively with a flange 50, 52 with the help of which the toner roller 40 is borne in the developer station 10, for example. The base body 42 and/or the adhesion layer 44 are also connected in an electrically conductive manner with a voltage source (not shown) via which the toner roller 40 is charged with a potential. If the base body 42 is not electrically conductive or is only slightly electrically conductive and the adhesive layer 44 is electrically conductive, at least the adhesive layer 44 must be connected in an electrically conductive manner with the electrical connection elements 54 through 60.

The dielectric layer 46 is arranged on the surface of the adhesion layer 44 and is comprised of a dielectric material. The dielectric layer 46 in particular is comprised of an inorganic coating, an enameling, anodized aluminum or a ceramic. In particular oxide ceramics (for example chromium oxide, aluminum oxide, titanium oxide or mixtures of these oxides) are used as ceramics. The ceramics are in particular thermally sprayed onto the adhesion layer 44. An additional possibility for the production of the dielectric layer 46 is the galvanic and/or chemical generation of the layer. For example, a dielectric layer 46 made of hard-anodized aluminum is produced in this way.

The cover layer 48 is arranged on the surface of the dielectric layer 46. The cover layer 48 serves to protect the dielectric layer 46 from abrasion, in particular from abrasion by the developer mixture or by the contact with another roller, and to protect against moisture. In particular given open-pored materials (for example ceramics), moisture can penetrate into the dielectric layer 46 without the cover layer 48. The electrical properties of the dielectric layer 46 are altered by the penetration of the moisture, such that the requirements that are posed for the toner roller 40 are not satisfied with certainty. If the toner roller 40 is used as a developer roller 24, the penetration of the moisture into the dielectric layer 46 can lead to the situation that a stable, homogeneous development of the latent charge image on the intermediate carrier 34 is no longer ensured. The abrasion of the toner roller 34 also leads to the situation that a stable, homogeneous development of the latent charge image on the intermediate carrier 34 can no longer be ensured. Furthermore, the cover layer 48 can also serve to protect the dielectric layer 46 from other environmental influences.

The cover layer 48 has a high electrical resistance. The electrical resistance of the cover layer 48 is in particular the resistance of a compensating resistance that results due to the handling (development) of the cover layer 48. The electrical resistance of the cover layer 48 is thus advantageously at least 3000Ω and is at maximum of such a high magnitude that the cover layer 48 at room temperature still has a higher conductivity than the dielectric layer 46. In other words, the cover layer has an optimally high electrical resistance on the one hand but on the other hand has a higher conductivity than the dielectric layer. An electrostatic charging of the toner roller 40 or the cover layer 48 is hereby prevented or at least reduced. Due to the conductivity of the cover layer 48, the occurrence of high point charges of the cover layer 48 is prevented since the charges distribute uniformly on the surface of the cover layer 48. By preventing high point charges (that are also called charge spikes), an inhomogeneous development of the latent charge image on the intermediate carrier 34 is also precluded. The cover layer 48 is also designed such that the electrical properties of the dielectric layer 46 are not affected by it or are at least not dominated by it.

The cover layer 48 is comprised, for example, of ceramics, in particular mixtures with titanium dioxide portion, lacquer, sol-gel layers, plastic or enamelings. The ceramics are advantageously thermally sprayed on. Furthermore, the cover layer 48 can be formed by a vapor-deposited layer, in particular by means of physical vapor deposition (PVD) or chemical vapor deposition (CVD).

The cover layer 48 must be homogeneous on the one hand and be completely sealed on the other hand, meaning that it must completely cover the dielectric layer 46. If the cover layer 48 is not completely sealed and/or the cover layer 48 exhibits inhomogeneities, it can lead to the situation that the toner particles are not uniformly distributed on the developer roller 24 and the thickness of the layer formed by the toner particles does not correspond to the preset layer thickness, and thus a stable, homogeneous development of the latent charge image of the intermediate carrier 34 is not ensured.

In an alternative embodiment of the invention, the cover layer 48 can be electrically charged with the aid of a charging unit in order to thus improve the application of the toner particles 40 and the jumping of the toner particles from the toner roller 40 onto the intermediate image carrier 34. In particular a roller, a mixture brush or a blade can be used as a charging unit.

The surface of the cover layer 48 has a preset minimum roughness via which the adhesion of the toner particles to the toner roller 40 is improved. The minimum roughness can be achieved either via the use of a material for the cover layer 48 that exhibits a corresponding roughness or via a corresponding roughening of the cover layer 48 in the production process of the toner roller 40.

Via the selection of the materials for the dielectric layer 46 and the cover layer 48, and thus its electrical properties (in particular the specific resistances and the permittivities) and via the selection of the layer thicknesses of the dielectric layer 46 and the cover layer 48 or the ratio of the layer thicknesses of these layers to one another, the electrical properties of the toner roller 40 (in particular the capacitance and the resistance) are matched to the requirements posed for the toner roller 40 depending on its usage purpose. The cover layer 48 advantageously has a thickness between 50 and 150 μm, in particular a thickness of approximately 100 μm, while the dielectric layer has a thickness between 1 μm and 10 mm, in particular a thickness of approximately 100 μm. The smaller the thickness of the dielectric layer 46 and the greater the permittivity of the material that the dielectric layer 46 is comprised of, the greater the capacitance of the toner roller 40. The capacitance of the toner roller 40 is likewise greater the smaller the thickness of the cover layer 48 and the greater the permittivity of the material that the cover layer 48 is comprised of. The greater the capacitance of the toner roller 40, the higher the number of toner particles that adhere to the toner roller 40 given the same electrical field strength. The toner quantity on the surface of the toner roller 40 can thus be set in a simple manner via the capacitance of the toner roller 40. Furthermore, the toner quantity on the surface of the toner roller can be adjusted via the field strength of the applied electrical field.

The temporal discharge and charge behavior of the toner roller 40 (and thus the take-up and output of charged toner particles) is also affected by the capacitance and the resistance of the toner roller. The temporal behavior of the discharging and charging of the toner roller 40 is also called the time response. The lower the capacitance and the lower the resistance of the toner roller 40, the faster the toner roller 40 discharges or charges. Such a low time response of the toner roller 40 is in particular advantageous given the use of the toner roller 40 as a developer roller 24 since the alternating field with which the developer roller 34 is charged can build up in a shorter amount of time, and toner particles can be taken up quickly and reliably from the inking roller 16 and can be discharged to the intermediate image carrier 24. Conversely, given the use of the toner roller 40 as a cleaning roller 32 it is advantageous if the cleaning roller 32 discharges only slowly so that as many toner particles as possible can be cleaned off the inking roller 24.

Furthermore, the materials for the cover layer 48 and the dielectric layer 46 as well as the respective layer thickness of the cover layer 48 and the dielectric layer 46 must be selected such that the breakdown resistance is sufficiently high so that no voltage puncture occurs, even at a high electrical field strength.

Figure 3:
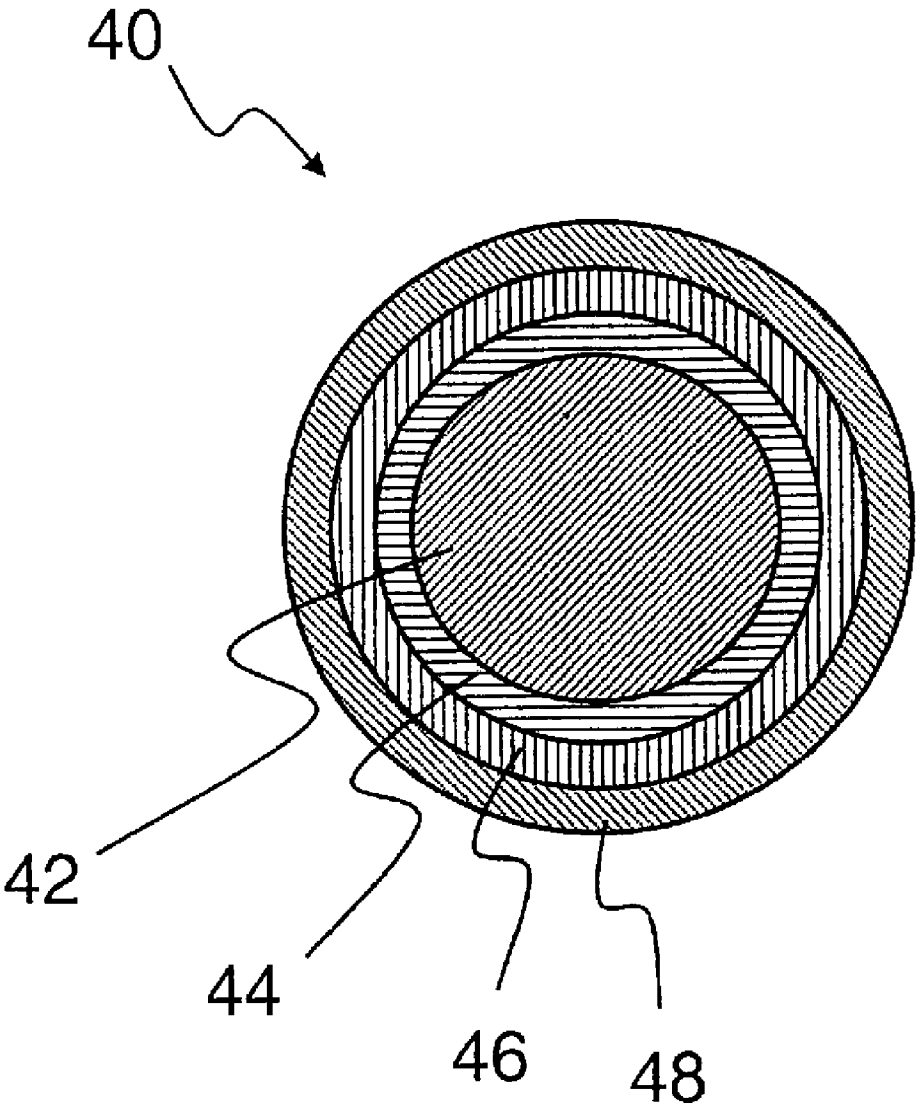
FIG. 3 is a cross-section through the toner roller according to FIG. 2.

A cross section through the toner roller 40 according to FIG. 2 is shown in FIG. 3. The base body 42 has a solid profile in the exemplary embodiment shown in FIG. 2.

In a preferred embodiment of the invention, the base body 42 is comprised of glass, the adhesion layer 44 is comprised of aluminum, the dielectric layer 46 is comprised of aluminum titanate and the cover layer 48 is comprised of chromium oxide. The adhesion layer 44 advantageously has a thickness of approximately 50 μm. The aluminum titanate layer and the chromium oxide layer respectively, advantageously have a thickness of approximately 100 μm.

Figure 4:
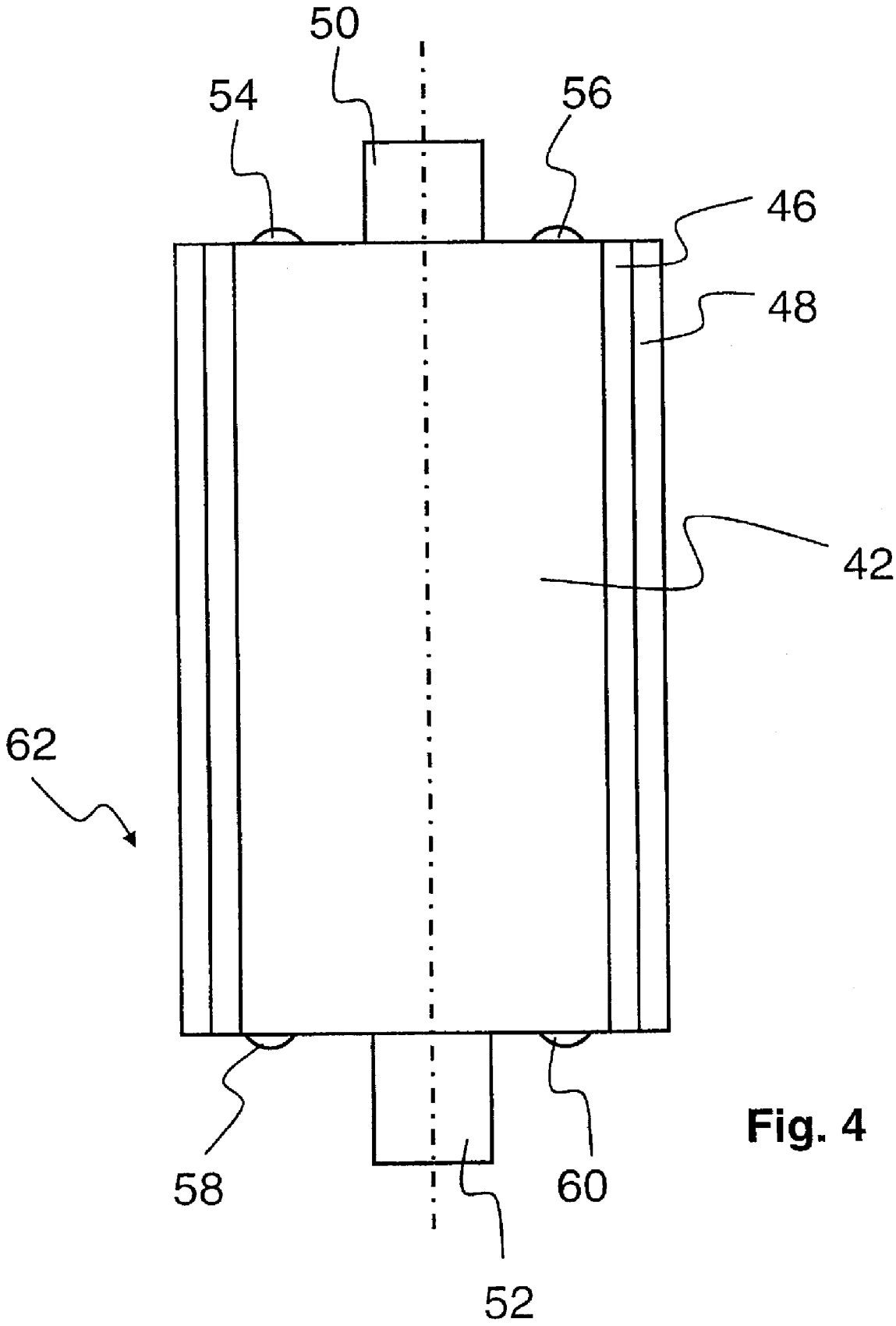
FIG. 4 is a longitudinal section through a toner roller according to a second embodiment of the invention.

A longitudinal section through a toner roller 62 according to a second embodiment of the invention is shown in FIG. 4. In contrast to the exemplary embodiment shown in FIGS. 2 and 3, in the exemplary embodiment according to FIG. 4 the dielectric layer 46 is applied directly to the surface shell of the base body 42. The base body 42 is electrically conductive and in particular has a conductivity of at least $10^6$ S/m at room temperature. The mechanical adhesion between the base body 42 and the dielectric layer 46 is sufficiently high so that no adhesion layer 44 is required.

Figure 5:
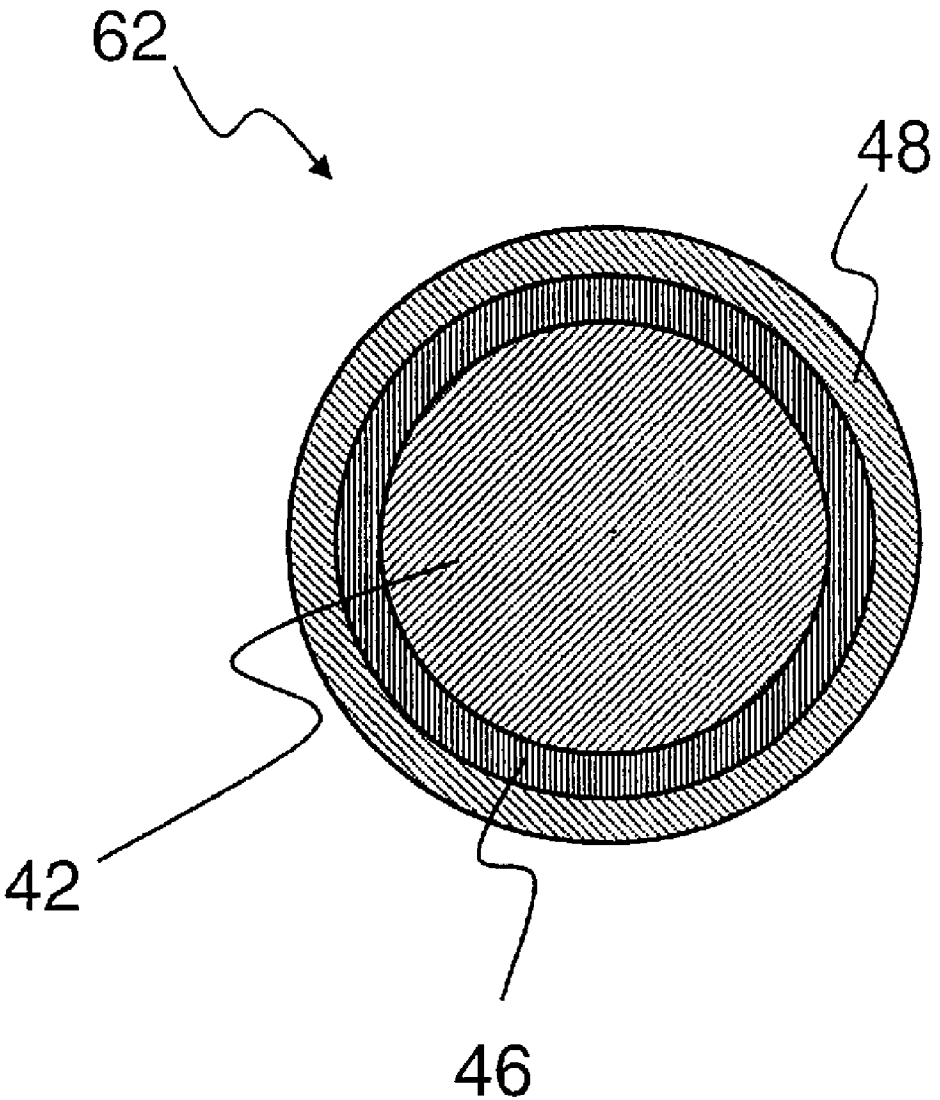
FIG. 5 is a cross-section through the toner roller according to FIG. 4.

A cross-section through the toner roller 62 according to FIG. 4 is shown in FIG. 5. In a preferred embodiment of the invention, the base body 42 is comprised of steel, the dielectric layer 46 is comprised of aluminum titanate, and the cover layer 48 is comprised of chromium oxide. The aluminum titanate layer and the chromium oxide layer advantageously, respectively have a thickness of approximately 100 μm. In an alternative embodiment of the invention, the base body 42 produced from steel is hollow, and thus tube-shaped. The thickness of the cover layer 48 is established depending on the electrical surface properties, in particular the surface conductivity and the bulk conductivity, of the material that is used.

The transition between the base body 42 and the adhesion layer 44, the transition between the adhesion layer 44 and the dielectric layer 46, the transition between the dielectric 46 and the cover layer 48 or, the transition between the base body 42 and the dielectric layer 46 are advantageously continuous, meaning that there are no clear boundaries between the layers. Alternatively, the layers can also transition step-by-step into one another.

The selection of the materials of the individual layers occurs at least dependent on the electrical properties of the materials and dependent on the production process.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. A toner roller suitable to take up a layer with toner particles, comprising:

a roller-shaped inner body;

a dielectric layer formed of an anodized aluminum or a ceramic metal oxide arranged on or outwardly spaced from an outer surface of the inner body;

a cover layer to protect the dielectric layer arranged on a surface of said dielectric layer;

the cover layer and the inner body having an electrical conductivity which is higher than an electrical conductivity of the dielectric layer; and said inner body, dielectric layer, and cover layer forming a capacitor.

2. The toner roller according to claim 1, in which the dielectric layer is comprised of a ceramic, an enameling, an inorganic lacquer, or anodized aluminum.

3. The toner roller according to claim 1 in which the cover layer has an electrical resistance of at least 3000 ohms.

4. The toner roller according to claim 1 in which the cover layer is homogeneous and the surface of the dielectric layer is completely covered by the cover layer.

5. The toner roller according to claim 1 in which the cover layer is comprised of a lacquer, an enameling, a plastic, or a ceramic.

6. The toner roller according to claim 1 in which the inner body comprises a tube-shaped base body or a roller-shaped base body comprised of a solid material, said base body being borne on both sides with aid of at least one respective bearing element.

7. The toner roller according to claim 6 in which the base body is comprised of steel, an aluminum-brass alloy, or a composite material.

8. The toner roller according to claim 1 in which the inner body comprises a roller-shaped base body and an adhesion layer is applied on the outer surface of the inner body for mechanical adhesion of the dielectric layer which is on a surface of the adhesion layer.

9. The toner roller according to claim 8, in which the adhesion layer is comprised of aluminum, molybdenum, chromium nickel or electroless nickel.

10. The toner roller according to claim 8 in which the base body has an electrical conductivity of less than 1000000 S/m at room temperature and the adhesion layer has an electrical conductivity of at least 1000000 S/m at room temperature.

11. The toner roller according to claim 10, in which the base body is comprised of glass, fiberglass, plastic, a composite material, or ceramic.

12. A toner roller suitable to take up a layer with toner particles, comprising:

a roller-shaped inner body;

a dielectric layer comprising metal arranged on or outwardly spaced from an outer surface of the inner body;

a cover layer to protect the dielectric layer arranged on a surface of said dielectric layer;

the cover layer and the inner body having an electrical conductivity which is higher than an electrical conductivity of the dielectric layer;

said inner body, dielectric layer, and cover layer forming a capacitor; and the dielectric layer being comprised of aluminum titanate, the cover layer being comprised of chromium oxide, and the dielectric layer and the cover layer respectively having a thickness in a range from 50 to 150 μm.

13. The toner roller according to claim 12, in which the inner body is comprised of steel or the inner body comprises a base body made of glass and an adhesion layer made of aluminum that is applied on an outer surface of the base body.

* * * * *